United States Patent [19]

Gulya et al.

[11] Patent Number: 5,002,638

[45] Date of Patent: Mar. 26, 1991

[54] PAPERMAKING MACHINE IN WHICH THE PAPER WEB IS SUPPORTED IN THE DRAW BETWEEN THE PRESS AND DRYER SECTIONS

[75] Inventors: Thomas G. Gulya, Appleton, Wis.; David R. Turner, Atlantic Beach, Fla.

[73] Assignee: Appleton Mills, Appleton, Wis.

[21] Appl. No.: 415,998

[22] Filed: Oct. 2, 1989

Related U.S. Application Data

[63] Continuation-in-part of Ser. No. 205,736, Jun. 13, 1988, abandoned.

[51] Int. Cl.[5] ..... D21F 5/02

[52] U.S. Cl. ..... 162/206; 162/290; 162/359; 34/41; 34/116; 34/123

[58] Field of Search ..... 162/204, 205, 206, 207, 162/306, 358, 360.1, 359, 375, 290; 34/116, 117, 123, 41, 15, 23, 26

[56] References Cited

U.S. PATENT DOCUMENTS

| | | | |
|---|---|---|---|
| 2,786,398 | 3/1957 | Sproull et al. | 162/202 |
| 3,250,019 | 5/1966 | Beachler | 34/117 |
| 3,526,574 | 9/1970 | Beachler et al. | 162/205 |
| 3,770,581 | 11/1973 | Orbison et al. | 162/348 |
| 3,891,501 | 6/1975 | Oka et al. | 162/290 |
| 3,981,084 | 9/1976 | Sobota | 34/123 |
| 4,000,035 | 12/1976 | Schiel et al. | 34/117 |
| 4,056,433 | 11/1977 | Koponen et al. | 162/290 |
| 4,526,655 | 7/1985 | Karvinen et al. | 162/359 |
| 4,561,939 | 12/1985 | Justus | 162/360 |
| 4,691,449 | 9/1987 | Wiberg | 162/206 |

FOREIGN PATENT DOCUMENTS

| | | |
|---|---|---|
| 474550 | 6/1951 | Canada . |
| 586264 | 11/1959 | Canada . |

OTHER PUBLICATIONS

Dimick, "Innovative Press Felt Design Helps Mill Improve Machine Runnability", Pulp and Paper, May 1989, pp. 114–118.

Britt, "Handbook of Pulp and Paper Technology", 1970, pp. 427–432.

*Primary Examiner*—Karen M. Hastings

*Attorney, Agent, or Firm*—Andrus, Sceales, Starke & Sawall

[57] ABSTRACT

A method of papermaking in which a wet paper web is supported on press felt and passed through the nip between cooperating press rolls to extract water from the web. The felt, supporting the paper web, then travels through a span of distance and is passed around a heated dryer roll in the dryer section with the felt being interposed between the heated roll and the paper web. The felt is thus heated and insulates the paper web from the high temperature roll. The paper web is separated from the felt and travels around the remaining dryer rolls in the dryer section, while the heated felt is returned to the nip into position to support the wet paper web.

3 Claims, 1 Drawing Sheet

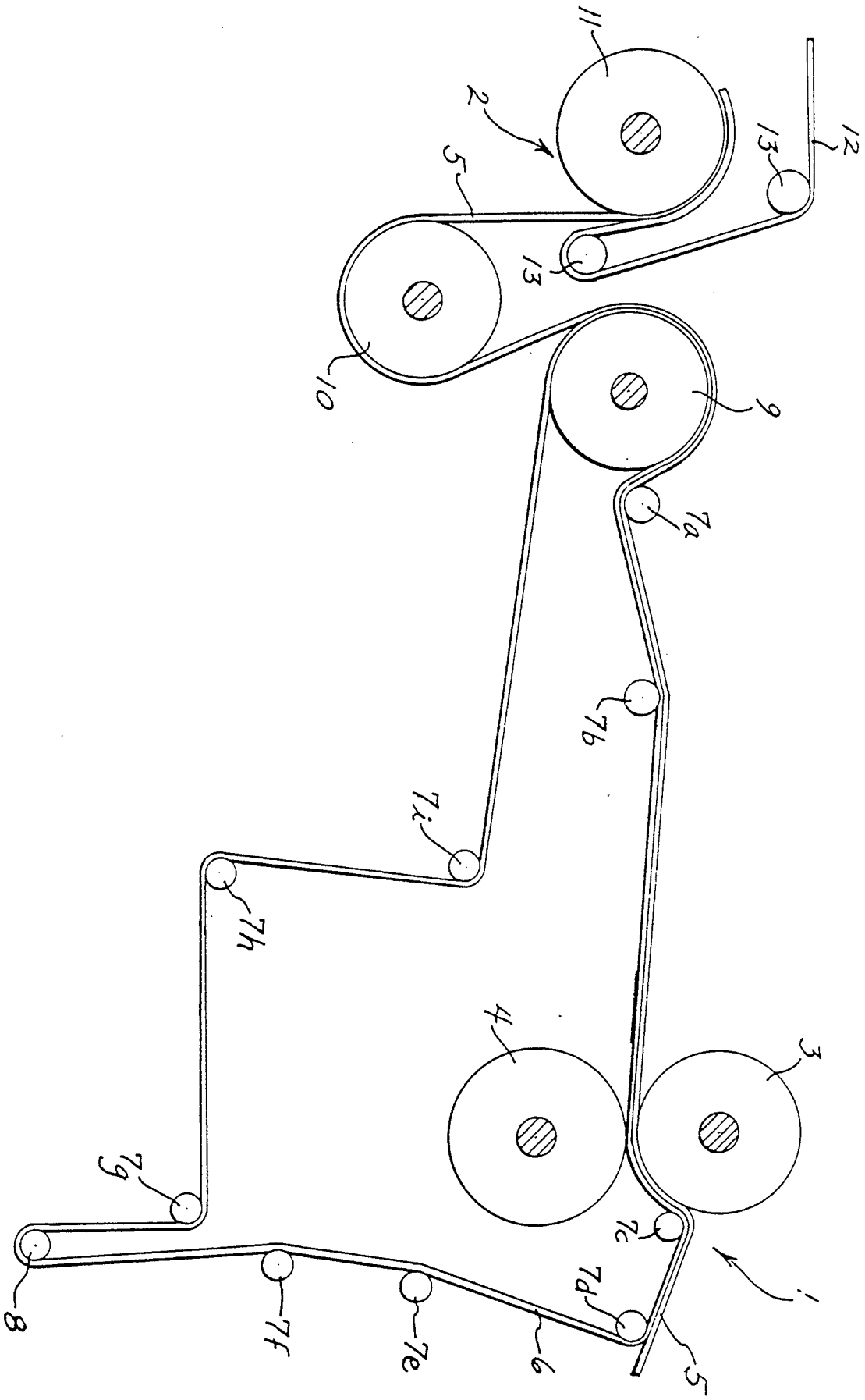
11
12
13
2
5
13
10
9
7a
7b
7i
7h
4
3
7g
7c
8
7f
7e
7d
6
5
1

PAPERMAKING MACHINE IN WHICH THE PAPER WEB IS SUPPORTED IN THE DRAW BETWEEN THE PRESS AND DRYER SECTIONS

RELATED APPLICATION

This application is a continuation-in-part of application Ser. No. 07/205,736, filed June 13, 1988, now abandoned.

BACKGROUND OF THE INVENTION

The conventional papermaking machine includes a press section having one or more pairs of cooperating press rolls and the wet paper web is supported on a papermaker's felt as it passes through the nip between the cooperating rolls, thereby extracting water from the web. After leaving the press section, the paper web is transferred to the dryer section which can consist of a plurality of heated dryer rolls. The paper web passes sequentially around the dryer rolls to remove further moisture from the paper.

In some installations, there is a substantial draw or span between the press section and the dryer section. The paper web is fairly wet and heavy, so that the web can sag in this draw and possibly break. A papermaking machine can be operating at a speed in the neighborhood of 2,000 ft. per minute, and if the web breaks, the paper web must be re-fed through the entire press and dryer sections and this not only results in a loss of product, but also results in substantial downtime for the papermaking machine.

Sag in the draw between the press section and the dryer section can be minimized by increasing the tension on the paper web, but an increase in tension will correspondingly tend to stretch the paper web and increase the tendency for breakage.

A dryer section of a conventional papermaking machine may include about ten to twelve steam heated dryer rolls or cylinders, commonly referred to as cans, and the first or upstream roll in the section, to which the wet paper web is transferred from the press section of the machine, is at a lower temperature than other downstream rolls. In practice, the upstream dryer roll will have a surface temperature of approximately 140° F. to 150° F., and the surface temperature of the next several downstream rolls will be progressively increased to a value of approximately 280° F. to 325° F., and this higher surface temperature will then be maintained throughout the remaining rolls of the series. By maintaining the temperature of the first dryer roll at a lower value, possible blistering and delamination of the paper web is prevented, and the lower temperature will also eliminate the tendency of the paper web to adhere to the roll.

SUMMARY OF THE INVENTION

The invention is directed to a papermaking machine in which the wet paper web is supported by the press section felt as it is transferred from the press section to the dryer section of the machine, thereby preventing sagging and possible breakage of the web. The press section includes a pair of cooperating press rolls and an endless papermaker's felt supports the paper web as it passes between the press rolls to extract water from the wet web.

The papermaking machine also includes a dryer section consisting of a group of heated dryer rolls, and the press section felt travels from the press rolls of the press section and passes around at least one of the dryer rolls, so that the felt acts to support the wet paper web in the span or draw between the press section and the dryer section and insulates the paper web from the dryer roll.

As the wet paper web is supported in the draw, sagging and possible breaking of the web is prevented in this area. As the tendency for breakage is minimized, product loss is minimized and downtime of the machine is correspondingly decreased.

Because the press felt is interposed between the heated dryer roll and the paper web, the paper web is insulated from the heated roll, and as a result the dryer roll can be operated at a substantially higher temperature than normal. By increasing the surface temperature of the upstream dryer roll, the number of dryer rolls in the dryer section can be reduced, thereby providing a substantial saving in capital expenditure.

As a further advantage, the press felt, after passing in contact with the heated dryer roll, will retain a portion of the heat through its endless travel so that the felt will be at an elevated temperature as it passes through the nip between the press rolls. Due to the increase in temperature of the felt at the nip, the viscosity of the water in the paper is reduced, thereby increasing the effectiveness of the water extraction at the nip and thus decreasing steam consumption in the dryer section.

Other objects and advantages will appear in the course of the following description.

DESCRIPTION OF THE DRAWINGS

The drawings illustrate the best mode presently contemplated of carrying out the invention.

The drawing is a schematic representation of a portion of a papermaking machine incorporating the invention.

DESCRIPTION OF THE ILLUSTRATED EMBODIMENT

The drawing is a schematic representation of a portion of a papermaking machine including a press section 1 and a dryer section 2. Press section 1 includes a pair of cooperating press rolls 3 and 4 and a wet paper web 5 is supported by a papermaker's felt 6 as it passes through the nip between the press rolls 3 and 4. The paper web can be any type of paper, preferably heavier paper, such as liner board, newsprint, writing paper, or the like.

The papermaker's felt 6 is endless in configuration and can consist of natural fibers, synthetic fibers, or a combination thereof. The particular construction or composition of the felt is not critical to the invention.

Felt 6 is supported in its endless travel by a plurality of idler rolls, indicated by *7a–7i*. In addition, the felt 6 passes around a tensioning or stretch roll 8, which is located between the rolls *7f* and *7g*. Roll 8 operates in a conventional manner to provide the desired tension on the felt 6.

Dryer section 2 includes a plurality of conventional heated dryer rolls, three of which are shown in the drawing, and indicated by 9, 10 and 11. In practice the dryer section may include up to ten or more rolls which are steam heated to a temperature in the range of 150° F. to 280° F. The temperature of the rolls in the group may be varied, with the highest temperature being located at the downstream end of the dryer section.

In certain installations, there may be a considerable gap or draw between press section 1 and dryer section 2 and this draw can be in the neighborhood of 10 to 15 feet. When dealing with a heavier weight paper, such as liner board, the paper web will be fairly wet and heavy as it leaves the press section, with the result that the paper web has a tendency to sag in the draw between press section 1 and dryer section 2. If the web should break, the paper web from the forming section must be dropped into a disposal site and then re-fed through the press section an dryer section. Refeeding the web may take from one-half to three-quarters of an hour and this down time results in a substantial decrease in the production rate of the papermaking machine.

To eliminate the sagging of the paper web in the draw between the press section and the dryer section and thereby prevent possible breaking of the web, the felt 6 from the press section is passed around at least one of the dryer rolls or cylinders in the dryer section. As illustrated, the felt is passed around dryer roll 9 and thus supports the paper web in the draw between the press rolls 3,4 and the dryer roll 9.

As illustrated, the web 5 is located on the outside of felt 6 as it passes around dryer roll 9 and the web then travels around roll 10 and 11. A conventional dryer fabric 12 is mounted for endless travel in the dryer section and as shown, travels around a pair of idler rolls 13. The dryer fabric 12 operates in a conventional manner to support the paper web against the heated dryer rolls to aid in removal of moisture from the web.

In certain installations, the first or upstream heated dryer roll in the dryer section may have a smaller diameter than the remaining dryer rolls of the section and, as such, may be referred to as a "baby" roll or can.

As shown in the drawing, the press felt 6 is interposed between the heated upstream dryer roll 9 and the paper web 5, thus insulating the paper web from the heated roll. Because of the insulating effect, the dryer roll 9 can be operated at a higher temperature than normal, generally in the range of about 240° F. to 280° F., as opposed to a conventional system where the upstream dryer roll, such as roll 9, is operated at a temperature of about 140° F. to 150° F. This also results in the succeeding downstream dryer rolls, such as 10 and 11, being operated at a higher temperature than conventional. For example, dryer roll 10, which is in direct contact with paper web 5, can have a surface temperature of approximately 180° F. to 200° F., well above the surface temperature of 140° F. to 160° F. employed in a conventional dryer section, and dryer roll 11 can be operated at a temperature of 190° F. to 210° F., again well above the temperature utilized in conventional practice. Thus, the final elevated temperature of about 280° F. is reached at an earlier stage in the dryer section, thus greatly improving the efficiency of the dryer operation, and enabling a lesser number of dryer rolls to be used in the dryer section.

As a further advantage, the press felt 6 passing over the heated dryer roll 9 will be heated and will retain a good portion of the heat throughout its endless travel, so that the felt returning to the nip between press rolls 3 and 4 will be at a temperature above 120° F. and generally at a range of about 140° F. to 180° F. This increased temperature will result in a reduction in the viscosity of the water, thus providing a more effective water extraction at the nip. It has been found that for every 18° F. increase in temperature at the nip, a 1% increase in water removal is achieved. In a conventional papermaking machine, a paper web is normally at a temperature of about 100° F. as it passes through the nip between press rolls 3 and 4. As this temperature is increased to a range of 140° F. to 180° F. in the invention, an increase in water removal of 2% or more is achieved, thus resulting in a substantial energy saving in the overall operation.

The position and number of the idler rolls 7 in the press section is not critical and various paths of travel for the felt are contemplated depending upon the requirements of the papermaking machine.

Various modes of carrying out the invention are contemplated as being within the scope of the following claims particularly pointing out and distinctly claiming the subject matter which is regarded as the invention.

We claim:

1. In a method of papermaking, comprising the steps of mounting a press felt for travel in an endless path, heating said felt, supporting a wet paper web on a surface of said heated felt, passing the heated felt and the supported web through a nip between a pair of cooperating press rolls to extract water from said web, passing the felt and the supported web through a span of distance from said nip to a first upstream dryer roll of a series of heated dryer rolls and positioning the felt in direct contact with said first dryer roll with said paper web being spaced from said dryer roll by said felt, exposing the outer surface of the portion of the web passing around the first dryer roll so that said outer surface is free of confinement to thereby reheat said felt and heat said paper web, releasing said paper web from said heated felt, and passing said paper web around the remaining downstream rolls in said series to dry said web.

2. The method of claim 1, wherein the step of positioning said felt into direct contact with said first dryer roll comprises a step of wrapping the felt around said first dryer roll through an arc of approximately 180°.

3. In a method of papermaking, the steps of mounting a press felt for travel in an endless path, positioning a first upstream dryer roll of a series of dryer rolls within said endless path so that said felt passes in direct contact with said first dryer roll, heating said first dryer roll to an elevated temperature, supporting a wet paper web on said felt, passing the felt and the supported web through a pressure nip to thereby extract water from said web, thereafter passing said felt and said supported web around said first heated dryer roll with said felt separating said web from said heated dryer roll, exposing the outer surface of the portion of the web passing around the first dryer roll so that said outer surface is free of confinement to thereby heat said felt and said web, separating the web from the felt, passing the web around the remaining downstream dryer rolls in said series, and returning the heated felt to the pressure nip in position to support said paper web.

* * * * *